US010898765B2

(12) United States Patent
Aramaki

(10) Patent No.: US 10,898,765 B2
(45) Date of Patent: Jan. 26, 2021

(54) GOLF CLUB SET

(71) Applicant: Sumitomo Rubber Industries, Ltd., Hyogo (JP)

(72) Inventor: Tomotaka Aramaki, Kobe (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 0 days.

(21) Appl. No.: 16/358,413

(22) Filed: Mar. 19, 2019

(65) Prior Publication Data

US 2019/0290975 A1 Sep. 26, 2019

(30) Foreign Application Priority Data

Mar. 22, 2018 (JP) ..... 2018-055354

(51) Int. Cl.
*A63B 53/04* (2015.01)
*A63B 102/32* (2015.01)
*A63B 53/00* (2015.01)

(52) U.S. Cl.
CPC ..... *A63B 53/0466* (2013.01); *A63B 53/005* (2020.08); *A63B 53/047* (2013.01); *A63B 53/0408* (2020.08); *A63B 53/0437* (2020.08); *A63B 2102/32* (2015.10)

(58) Field of Classification Search
CPC ..... A63B 53/0466; A63B 2102/32; A63B 53/047; A63B 2053/005; A63B 2053/0408; A63B 2053/0437; A63B 53/04; A63B 53/005
See application file for complete search history.

(56) References Cited

U.S. PATENT DOCUMENTS 5,501,460 A * 3/1996 Scheie ..... A63B 53/04 473/290
2005/0209018 A1* 9/2005 Yamamoto ..... A63B 53/047 473/324
2014/0228143 A1* 8/2014 Roach ..... A63B 53/0475 473/291
2016/0354653 A1* 12/2016 Aramaki ..... A63B 53/0466

FOREIGN PATENT DOCUMENTS

JP 2000-116828 * 4/2000 ..... A63B 53/004
JP 2015-29628 A 2/2015

* cited by examiner

*Primary Examiner* — Michael D Dennis
(74) *Attorney, Agent, or Firm* — Studebaker & Brackett PC

(57) ABSTRACT

The present disclosure is a golf club set constituted by a plurality of golf clubs having different loft angles, each of the golf clubs has a shaft and a golf club head, and each of the golf club heads has a crown part, a face part, a sole part, and a hosel part to which the shaft is attached.

17 Claims, 11 Drawing Sheets

E1 cross-section

GOLF CLUB SET

TECHNICAL FIELD

The present invention relates to a golf club set.

BACKGROUND ART

A golf club set typically includes multiple clubs having different loft angles (e.g., JP 2015-29628A). Clubs having low loft angles are used to achieve longer flight distances. On the other hand, clubs having high loft angles are used for shots when near the green, where the player often aims for the small area of the green. As such, when using clubs having high loft angles, putting more backspin on the ball is effective in order to stop the ball on the green. During a game, golf clubs are selected from the golf club set in accordance with purposes such as the above.

JP 2015-29628A is an example of the related art.

SUMMARY OF THE INVENTION

Incidentally, when a golf club is selected from a golf club set such as the above, although the design of the golf clubs is uniform, the golf club head looks different for each golf club when addressing the ball, due to the difference in the loft angles. As such, when playing a shot using a different golf club, the player may feel a sense of incongruity and have trouble addressing the ball. The present invention was made in order to solve this problem, and an object of the present invention is to provide golf club heads that can reduce the sense of incongruity felt at address between multiple golf clubs.

A golf club set according to the present invention is constituted by a plurality of golf clubs having different loft angles, wherein each of the golf clubs includes a shaft and a golf club head; each of the golf club heads includes: a crown part; a face part; a sole part; and a hosel part to which the shaft is attached, and in the face part, a lower edge line that is a boundary with the sole part curves so as to protrude downward. When a first point, a second point, and a third point are defined on the lower edge line, the first point being a lowermost point when the golf club head is in a reference state, the second point being a toe-side end, and the third point being a midpoint between the first point and the second point in a toe-heel direction, the lower edge line includes a first toe-side lower edge line that extends from the second point to the third point, and a second toe-side lower edge line that extends from the first point to the third point, and, out of the plurality of golf clubs, at least a pair of a first golf club having a lower loft angle and a second golf club having a higher loft angle are configured such that a curvature radius of the first toe-side lower edge line of the second golf club is smaller than a curvature radius of the first toe-side lower edge line of the first golf club.

In the above-described golf club set, a difference between the curvature radius of the first toe-side lower edge line of the first golf club and the curvature radius of the first toe-side lower edge line of the second golf club may be within 20 mm.

In the above-described golf club set, the plurality of golf clubs may include a golf club in which the first toe-side lower edge line has a curvature radius of 20 to 40 mm.

In the above-described golf club set, the first golf club and the second golf club may be configured such that the curvature radius of the second toe-side lower edge line of the second golf club is larger than the curvature radius of the second toe-side lower edge line of the first golf club.

In the above-described golf club set, the difference between the curvature radius of the second toe-side lower edge line of the first golf club and the curvature radius of the second toe-side lower edge line of the second golf club may be within 40 mm.

The above-described golf club set may include a golf club in which the second toe-side lower edge line has a curvature radius of 60 to 120 mm.

In the above-described golf club set, a length of each of the golf club heads in the toe-heel direction may be 60 to 120 mm.

In the above-described golf club set, when the first point, a fourth point, and a fifth point are defined on the lower edge line, the fourth point being an intersection point of the lower edge line and a plane that passes through the intersection point of a center axis line of the shaft in the reference state and a placement surface and that is perpendicular to the toe-heel direction, and the fifth point being a midpoint between the first point and the fourth point in the heel-toe direction, the lower edge line includes a first heel-side lower edge line that extends from the fourth point to the fifth point, and a second heel-side lower edge line that extends from the first point to the fifth point, and, out of the plurality of golf clubs, at least a pair of a first golf club having a lower loft angle and a second golf club having a higher loft angle may be configured such that a curvature radius of the first heel-side lower edge line of the second golf club is smaller than a curvature radius of the first heel-side lower edge line of the first golf club.

In the above-described golf club set, the first golf club and the second golf club may be configured such that the curvature radius of the second heel-side lower edge line of the second golf club is larger than the curvature radius of the second heel-side lower edge line of the first golf club.

A second golf club set according to the present invention is a golf club set constituted by a plurality of golf clubs having different loft angles, wherein each of the golf clubs includes a shaft and a golf club head, each of the golf club heads includes: a crown part; a face part; a sole part; a hosel part to which the shaft is attached, and in the face part, a lower edge line that is a boundary with the sole part curves so as to protrude downward, and when a first point, a fourth point, and a fifth point are defined on the lower edge line, the first point being the lowermost point when the golf club head is in a reference state, the fourth point being an intersection point of the lower edge line and a plane that passes through an intersection point of a center axis line of the shaft in the reference state and a placement surface and that is perpendicular to a toe-heel direction, and the fifth point being a midpoint between the first point and the fourth point, the lower edge line includes a first heel-side lower edge line that extends from the fourth point to the fifth point, and a second heel-side lower edge line that extends from the first point to the fifth point, and, out of the plurality of golf clubs, at least a pair of a first golf club having a lower loft angle and a second golf club having a higher loft angle are configured such that the curvature radius of the first heel-side lower edge line of the second golf club is smaller than a curvature radius of the first heel-side lower edge line of the first golf club.

In the above-described second golf club set according to the present invention, the curvature radius of the second heel-side lower edge line of the second golf club may be larger than the curvature radius of the second heel-side lower edge line of the first golf club.

With the golf club head according to the present invention, it is possible to reduce the sense of incongruity felt at address between multiple golf clubs.

EMBODIMENTS OF THE INVENTION

An embodiment of a golf club set according to the present invention will be described hereinafter with reference to the drawings. The golf clubs constituting the golf club set according to the present embodiment are utility type (also called "hybrid type") golf clubs. The clubs are, for example, #2 to #8 utilities, having club lengths from 36 to 42 inches and loft angles from 15 to 35°. As will be described later, the clubs differ mainly in terms of the loft angle and so on. The following will first use a single golf club as an example to give a general overview of the structures common to the clubs. Then, the differences between the golf clubs in the golf club set will be described in detail.

1. Overview of Golf Club Head

Figure 1:
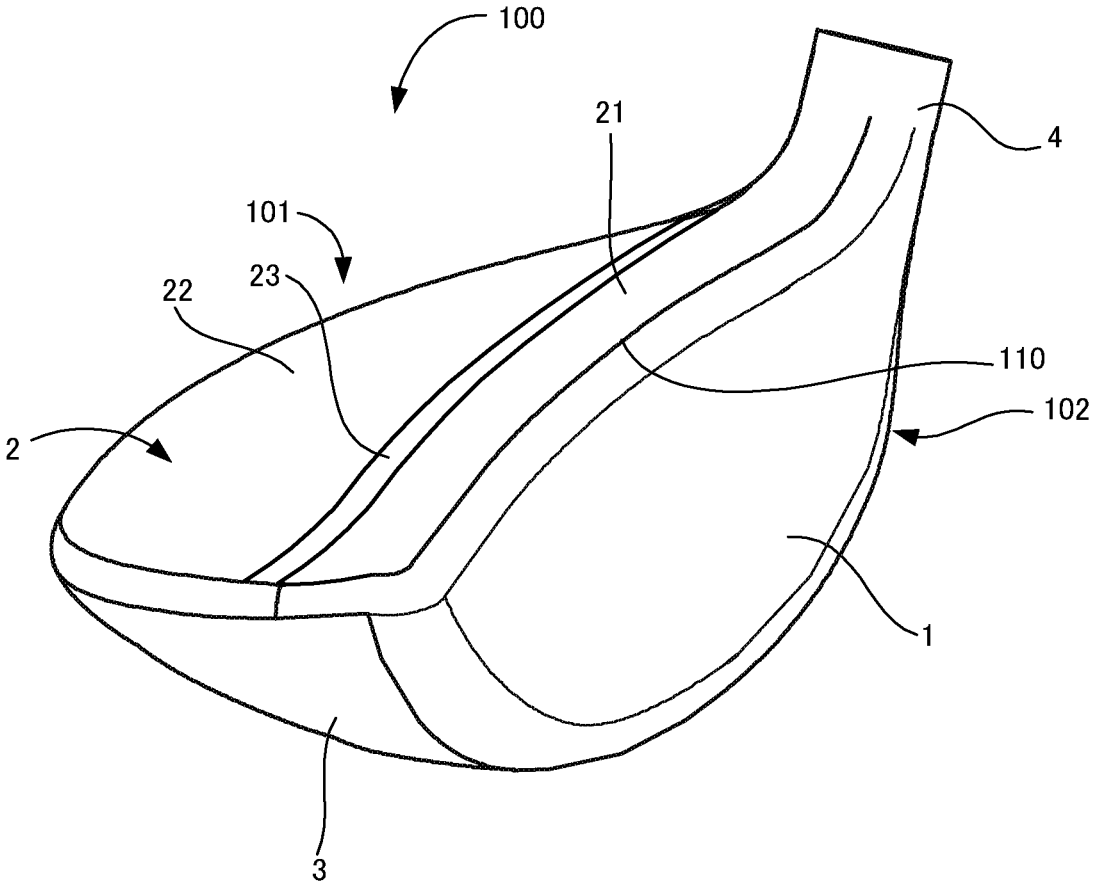
FIG. 1 is a perspective view of a golf club head included in a golf club set according to an embodiment of the present invention.
Figure 2:
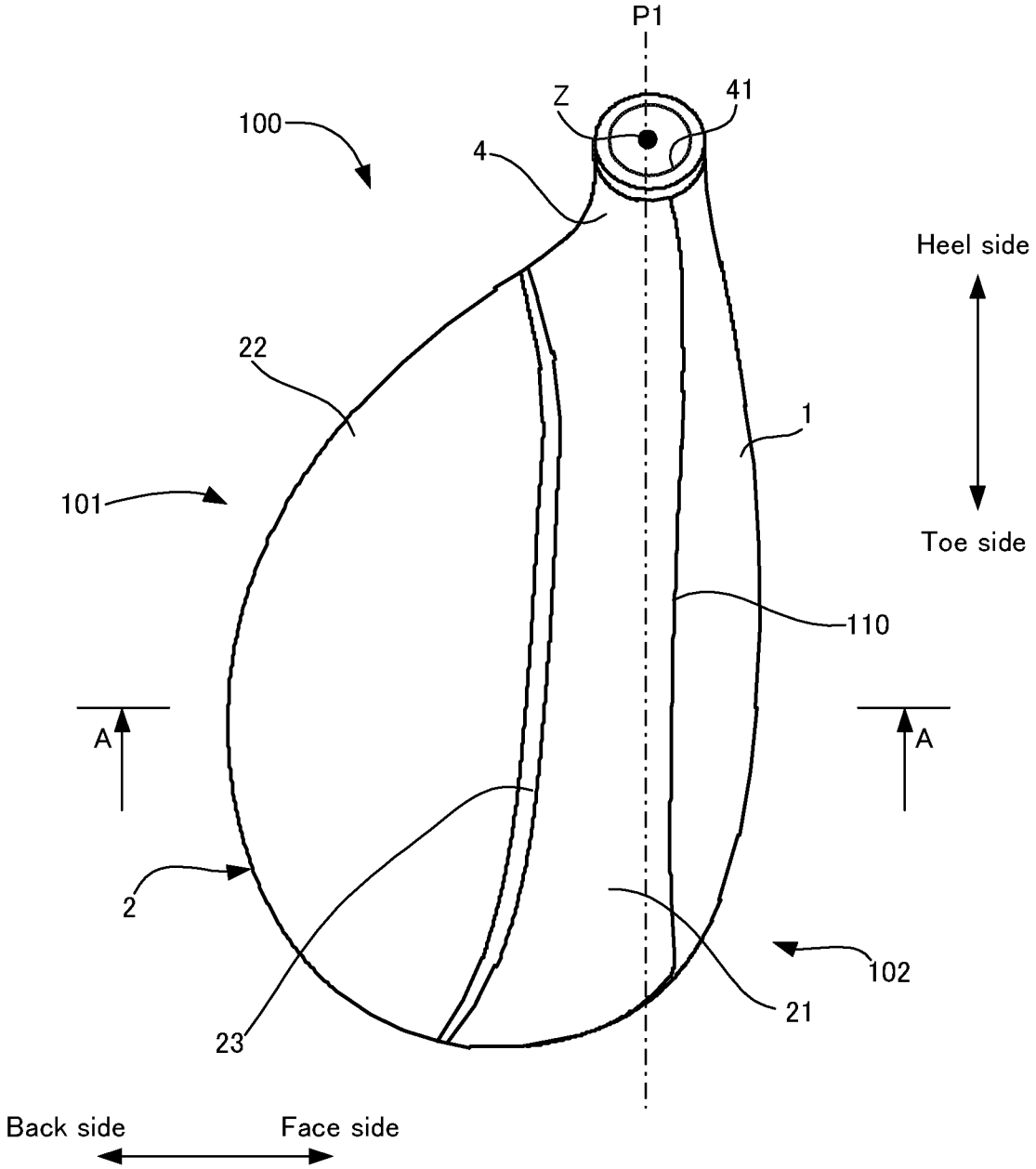
FIG. 2 is a plan view of the golf club head in FIG. 1 in a reference state.
Figure 3:
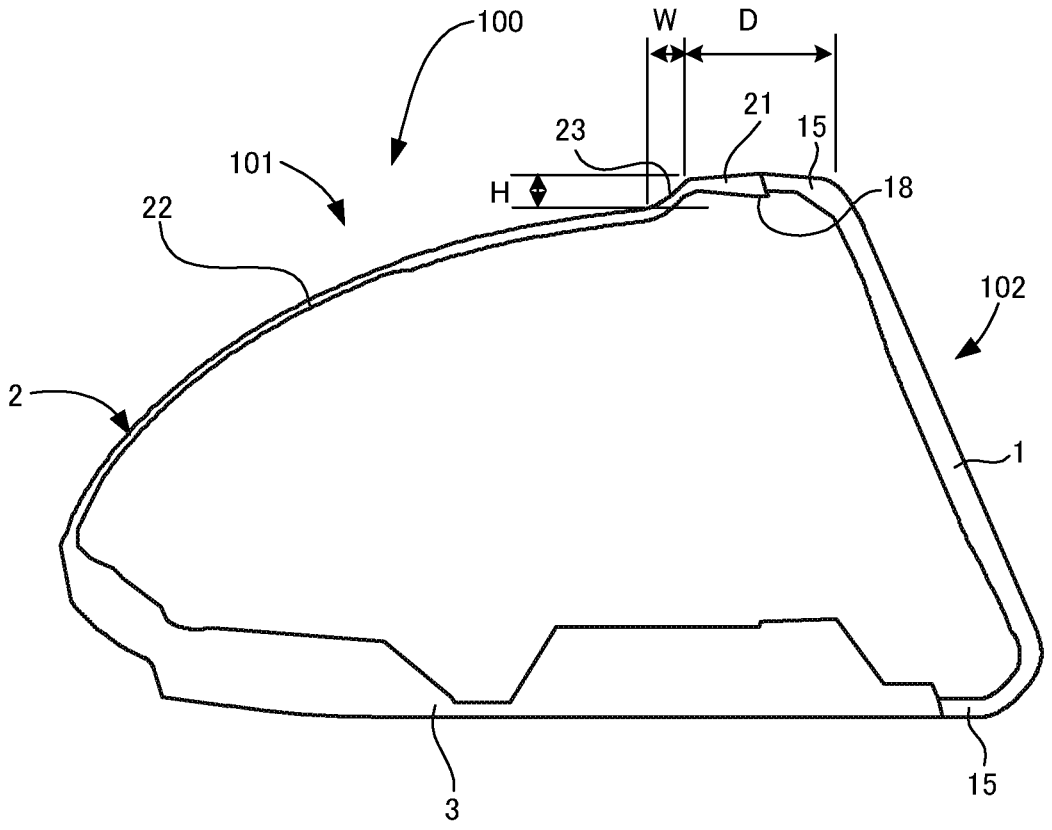
FIG. 3 is a cross-sectional view taken along A-A in FIG. 2.

First, a single golf club (e.g., a utility type golf club) in the golf club set according to the present embodiment will be used as an example to describe the golf club head. FIG. 1 is a perspective view of a single golf club head in the golf club set according to the present embodiment, shown in a reference state. FIG. 2 is a plan view corresponding to FIG. 1. FIG. 3 is a cross-sectional view taken from a line A-A in FIG. 2. The reference state of the golf club head will be described later.

As illustrated in FIGS. 1 to 3, the golf club head (also sometimes called simply a "head" hereinafter) 100 is a utility type golf club head. The head has a hollow construction with an internal space, and wall surfaces are formed by a face part 1, a crown part 2, a sole part 3, and a hosel part 4.

The face part 1 has a face surface, which is a surface that strikes a ball. The crown part 2 is adjacent to the face part 1 and forms an upper surface of the head 100. The sole part 3 mainly forms a bottom surface of the head 100, and constitutes the outer peripheral surface of the head 100 excluding the face part 1 and the crown part 2. In other words, in addition to the bottom surface of the head 100, a part extending from a toe side of the face part 1, across a back side of the head 100, and to a heel side of the face part 1 is part of the sole part 3. Furthermore, the hosel part 4 is a part provided adjacent to a heel side of the crown part 2, and has an insertion hole 41 into which a shaft (not shown) of a golf club is inserted. A center axis line Z of the insertion hole 41 coincides with an axis line of the shaft.

A reference state when the golf club head 100 is placed on the ground surface will be described next. First, as illustrated in FIG. 2, a state in which the center axis line Z is contained in a plane P1 perpendicular to the ground surface and the head is placed on the ground surface at a prescribed lie angle and real loft angle is defined as the "reference state". The plane P1 is called a "reference vertical plane". Also, as illustrated in FIG. 2, the direction of an intersecting line between the reference vertical plane P1 and the ground surface is called a "toe-heel direction", and a direction perpendicular to the toe-heel direction and parallel to the ground surface is called a "face-back direction". Also, a direction that is orthogonal to the toe-heel direction and the face-back direction is called an "up-down direction" in some cases.

Figure 4A:
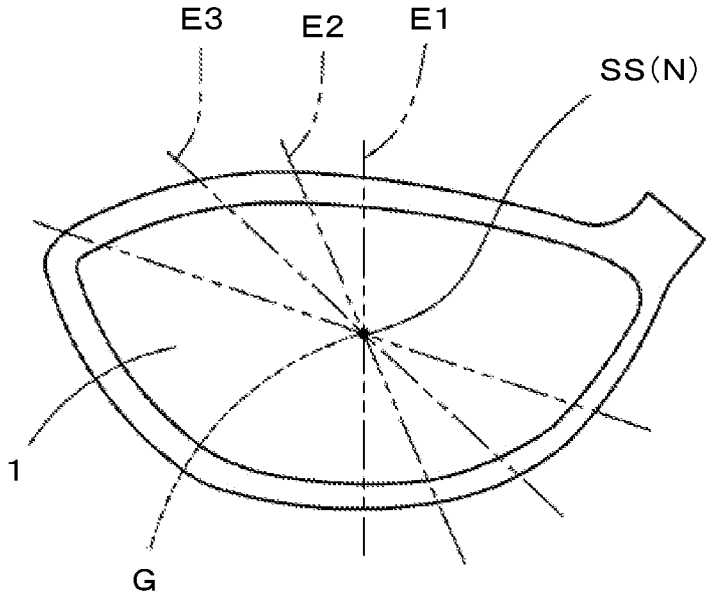
FIG. 4A is a diagram illustrating the boundaries of a face part.
Figure 4B:
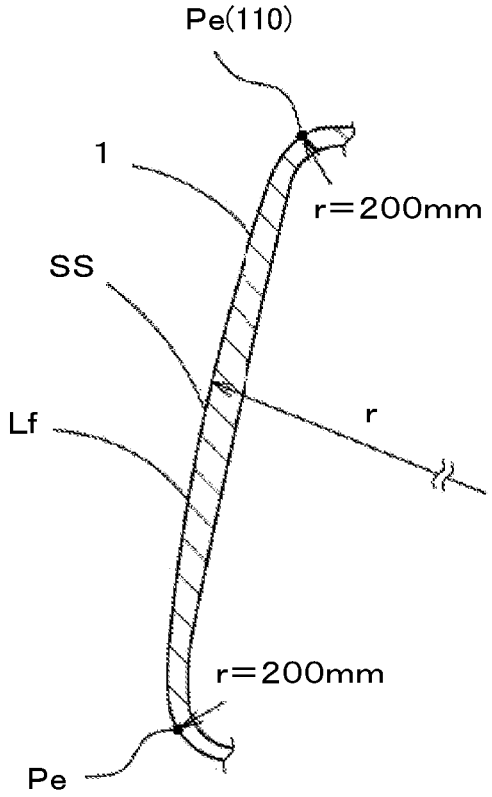
FIG. 4B is a diagram illustrating the boundaries of the face part.

In the present embodiment, a boundary between the face part 1 and the crown part 2 and a boundary between the face part 1 and the sole part 3 can be defined as follows. If a ridge line is formed between these parts, that ridge line serves as the boundary. However, if a clear ridge line is not formed, the boundaries are defined as follows. In each of cross-sections E1, E2, E3, and so on illustrated in FIG. 4A, each of which contains a straight line N connecting a head center of gravity G with a sweet spot SS, a position Pe where a curvature radius r of a face outer surface contour line Lf first reaches 200 mm while moving from the sweet spot side toward the face outer side, as illustrated in FIG. 4B, serves as a peripheral edge of the face part 1. This is defined as the boundary with the crown part 2 or the sole part 3. The "sweet spot SS" is a point of intersection between a normal line of the face surface passing through the head center of gravity G (the straight line N) and that face surface. Also, in this specification, out of the above-described boundaries Pe, the boundary between the face part 1 and the sole part 3 is called a lower edge line 7 of the face part 1.

In the present embodiment, a boundary between the crown part 2 and the sole part 3 can be defined as follows. If a ridge line is formed between the crown part 2 and the sole part 3, that ridge line serves as the boundary. However, if a clear ridge line is not formed between these parts, a contour seen from directly above the center of gravity of the head 100 when the head is placed in the reference state serves as the boundary.

The head 100 can be formed of, for example, a titanium alloy (Ti-6Al-4V, Ti-8Al-1Mo-1V, or the like) having a relative density of approximately 4.3 to 4.5. Aside from titanium alloys, the head can be formed using one or more of stainless steel, maraging steel, an aluminum alloy, a magnesium alloy, an amorphous alloy, and so on, for example.

Figure 5:
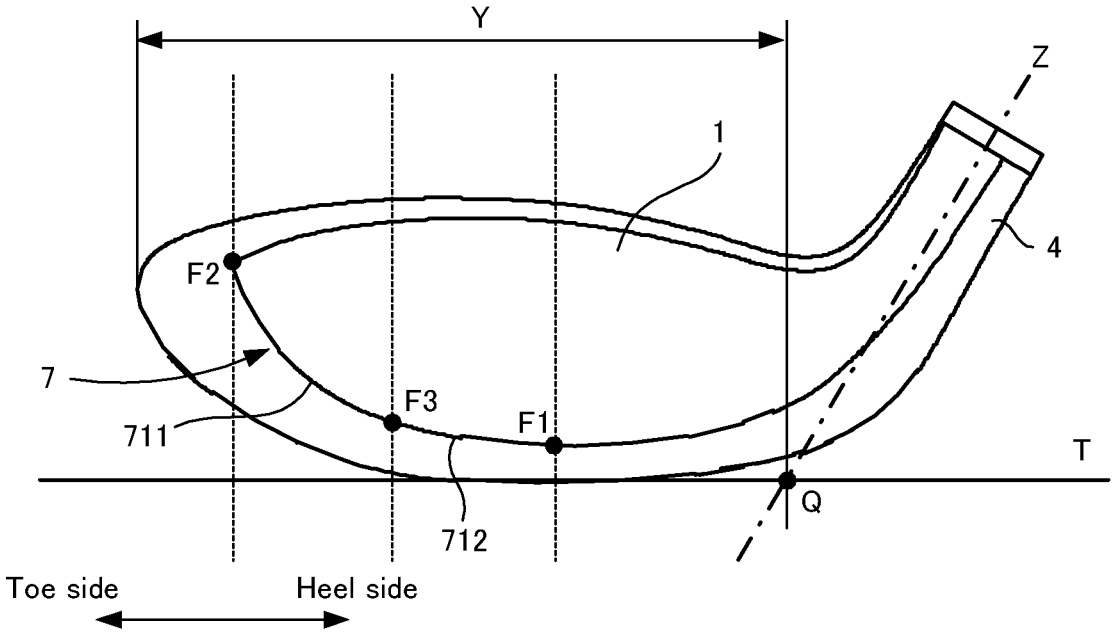
FIG. 5 is a front view of the golf club head illustrating a lower edge line of the face part.

The volume of the golf club head 100 is desirably greater than or equal to 90 $cm^3$ and less than or equal to 200 $cm^3$, for example. The length Y of the golf club heads in the toe-heel direction is preferably 60 to 120 mm. As illustrated in FIG. 5, when a position at which the extended line of the center axis Z of the shaft intersects a placement surface T (ground) is given as a reference point Q, the length in the toe-heel direction here denotes the length Y in the toe-heel direction between the reference point Q and a point that is closest to the toe when the head in the reference state is viewed from the front.

2. Assembly Structure of Golf Club Head

As illustrated in FIG. 3, the golf club head 100 according to the present embodiment is formed by assembling a head main body 101, which includes the crown part 2 and the sole part 3, with a face member 102, which includes the face part 1 and a peripheral edge part 15 extending from the peripheral edges of the face part 1 to form a cup-like shape. The head main body 101 has an opening 18 surrounded by the crown part 2 and the sole part 3, and the face member 102 is attached so as to cover the opening 18. In other words, an end surface of the peripheral edge part 15 of the face member 102 is butted against an end surface of the opening 18 in the head main body 101, and these end surfaces are joined together by welding (so-called a "cup face construction"). The face member 102 is integrated with the head main body 101 by being attached to the edges of the opening 18 in the head main body 101. As a result, the peripheral edge part 15 of the face member 102 functions as a part of the crown part 2 and the sole part 3 of the head 100.

Accordingly, an integral surface formed by attaching the peripheral edge part 15 of the face member 102 to the head main body 101 forms the crown part 2 and the sole part 3 of the head 100. As such, the crown part 2 and the sole part 3 of the head main body 101 are, strictly speaking, parts of the crown part 2 and the sole part 3 of the head 100. However, this specification may not make this distinction, and the parts of the head main body 101 may also being referred to simply as the crown part 2 and the sole part 3.

3. Structure of Crown Part

The crown part 2 will be described next. As illustrated in FIGS. 1 to 3, the crown part 2 includes a protruding part 21 located on the face part 1 side and a base part 22 located further on the back side than the protruding part 21. The protruding part 21 is mainly a band-shaped region extending along the face part 1 in the toe-heel direction. On the other hand, the base part 22 is a region occupying most of the crown part 2 at a position lower than the protruding part 21, and the peripheral edges of the base part 22 contact the sole part 3. A sloped surface 23, which forms a step, is formed at the boundary between the protruding part 21 and the base part 22. As such, the height of the face part 1 in an up-down direction is higher by the size of the step between the protruding part 21 and the base part 22.

The sloped surface 23 is formed so as to extend downward as the sloped surface 23 progresses toward the back. Thus when the golf club head 100 is placed in the reference state, the sloped surface 23 can be seen from above. In other words, the sloped surface 23 can be seen by a golfer in the address position. The sloped surface 23 is formed along the protruding part 21, and thus like the protruding part 21, is formed in a band shape when viewed in plan view.

As illustrated in FIG. 3, a width D of the protruding part 21 in the face-back direction is, for example, preferably from 5 to 25 mm and more preferably from 7 to 20 mm, when viewed in plan view.

Additionally, a width W of the sloped surface 23 in the face-back direction when viewed in plan view is, for example, preferably from 1 to 9 mm and more preferably from 2 to 7 mm. Furthermore, a height H of the sloped surface 23 is, for example, preferably from 0.5 to 8 mm, more preferably from 0.5 to 6 mm, and particularly preferably from 0.5 to 5 mm.

4. Method of Manufacturing Golf Club Head

An example of a method of manufacturing the above-described golf club head will be described next. First, the above-described head main body 101 and face member 102 are prepared. The head main body 101 and the face member 102 can be manufactured by a variety of methods. For example, the head main body 101 can be manufactured using a known casting method such as lost-wax precision casting. The face member 102 can be manufactured by a forging method, a process of pressing a flat plate, casting, or the like, for example. Also, when the face member 102 is formed by a rolled material, the pre-processing flat plate is processed such that the rolling direction substantially coincides with the direction from an upper part of the face part 1 on the toe side to a lower part on the heel side.

These members are then joined through welding, for example (tungsten-inert gas (TIG) welding, plasma welding, laser welding, brazing, or the like). Then, once predetermined coating has been carried out, the golf club head is complete.

5. Differences Between Golf Clubs in Golf Club Set

First, a lower edge line 7 of the face part 1 will be defined next with reference to FIG. 5. FIG. 5 is a front view of a golf club head in the reference state. As described above, the lower edge line 7 is the boundary between the face part 1 and the sole part 3, and curves so as to protrude downward. The lowermost point on the lower edge line 7 when the golf club head is in the reference state is denoted as F1 (first point), and the end portion on the toe side is denoted as F2 (second point). A midpoint between F1 and F2 in the toe-heel direction is denoted as F3. Of the lower edge line, a portion extending between F2 and F3 is defined as a first toe-side lower edge line 711, and a portion extending between F1 and F3 is defined as a second toe-side lower edge line 712.

Figure 6:
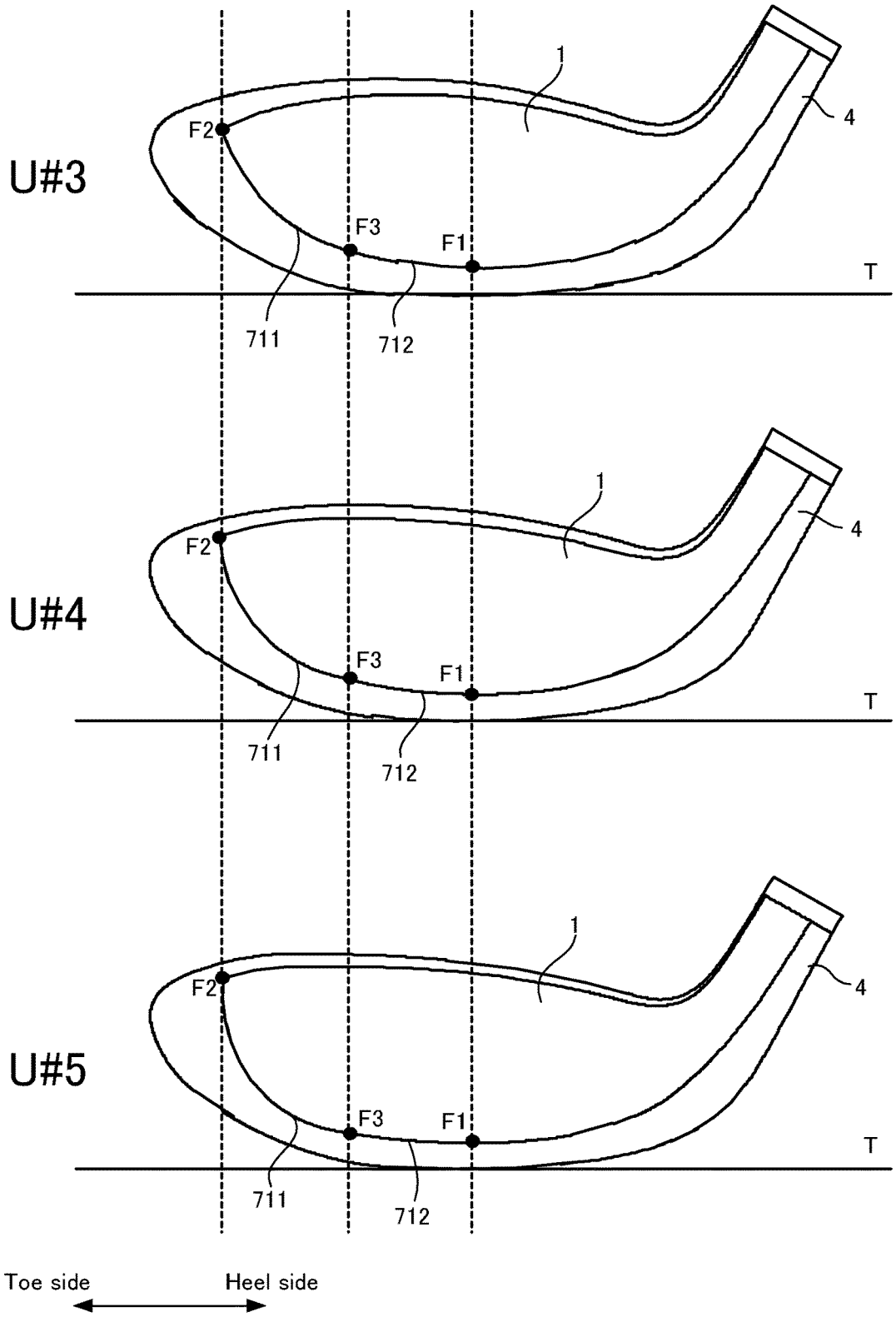
FIG. 6 is a front view of golf club heads having different loft angles that are included in a golf club set according to the present invention.

Next, differences between the golf clubs having different loft angles in the golf club set will be described with reference to FIG. 6. FIG. 6 is a front view of multiple golf club heads in the reference state when viewed from the face side. FIG. 6 illustrates the heads of three golf clubs, having consecutive numbers, in the golf club set according to the present embodiment as an example. These are arranged in order from top to bottom, in ascending order of loft angle, i.e., a #3 utility (U #3), a #4 utility (U #4), a #5 utility (U #5). Note that in FIG. 6, the heads are illustrated in a slightly exaggerated manner to make the features of the invention with respect to the difference between the golf clubs clear. Thus, the actual dimensions and so on which will be described later are different from those in FIG. 6, but this has no effect on the essence of the invention. Note that dimensions of the heads described hereinafter refer to dimensions in the reference state unless otherwise specified. Furthermore, among any two of the golf clubs (U #3, U #4, and U*5) according to the present embodiment, the club having a lower loft angle corresponds to the first golf club of the present invention, and the club having a higher loft angle corresponds to the second golf club of the present invention.

In FIG. 6, three golf clubs are placed on the placement surface T in the reference state, and the above-described three points F1, F2, and F3 on the lower edge line 7, the first toe-side lower edge line 711, and the second toe-side lower edge line 712 are illustrated. In the golf clubs according to the present invention, the face part 1 is formed such that clubs having higher loft angles have a smaller curvature radius of the first toe-side lower edge line 711, and clubs having lower loft angles have a larger curvature radius of the second toe-side lower edge line 712. Here, when the curvature radii of the first toe-side lower edge lines 711 of U #3, U #4, and U #5 are denoted as M1, M2, and M3, respectively, and the curvature radii of the second toe-side lower edge lines 712 of U #3, U #4, and U #5 are denoted as N1, N2, and N3, respectively, the relationships M1>M2>M3, and N1<N2<N3 hold true.

Figure 7:
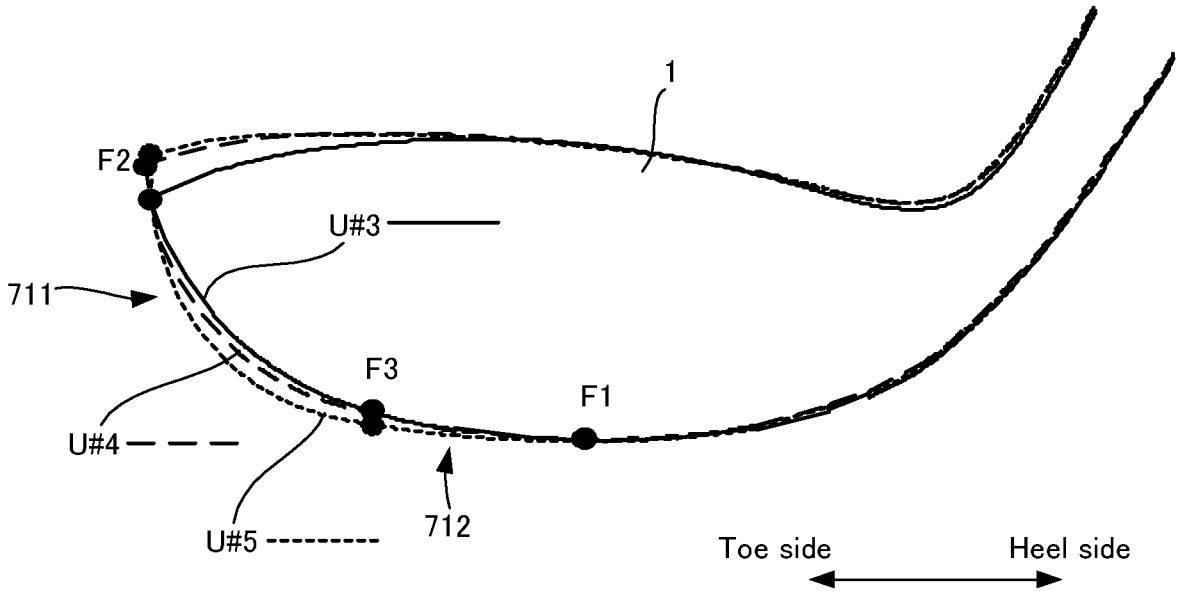
FIG. 7 is a diagram illustrating a state in which the face parts of golf club heads having different loft angles that are included in the golf club set according to the present invention are superimposed on each other.

Hereinafter, this point will be described in detail with reference to FIG. 7. FIG. 7 is a view where the face parts of the golf clubs (U #3, U #4, and U #5) illustrated in FIG. 6 are shown in a superimposed manner in which the first points F1 are aligned. As shown in FIG. 7, for example, the first toe-side lower edge line 711 of U #5 having the highest loft angle curves downward more than the other clubs and has a smaller curvature radius. On the other hand, the second toe-side lower edge line 712 of U #5 is nearly straight compared to U #3 and U #4, and has a larger curvature radius. Specifically, the curvature radii can be set as follows, for example, but the present invention is not intended to be limited thereto.

TABLE 1

| | Curvature radius of first toe-side lower edge line | Curvature radius of second toe-side lower edge line |
|---|---|---|
| U#3 | 32.4 mm | 85.4 mm |
| U#4 | 27.4 mm | 90.4 mm |
| U#5 | 24.6 mm | 116.33 mm |

Also, the curvature radius of the first toe-side lower edge line 711 is preferably 20 to 40 mm. The difference between the curvature radii of the first toe-side lower edge lines 711 of clubs having consecutive numbers (e.g., U #3 and U #4) is preferably 1 to 20 mm. According to the present embodiment, the sense of incongruity felt at address between clubs having different numbers can be reduced, as will be described later, but the above range is specified because, especially if the difference between the curvature radii is too large, the sense of incongruity felt at address between clubs having different numbers will conversely increase.

On the other hand, the curvature radius of the second toe-side lower edge line 712 is preferably 60 to 120 mm. The difference between the curvature radii of the second toe-side lower edge lines 712 of clubs having consecutive numbers (e.g., U #3 and U #4) is preferably 1 to 40 mm. According to the present embodiment, the sense of incongruity felt at address between clubs having different numbers can be reduced, as will be described later, but the above range is specified because, especially if the difference between the curvature radii is too large, the sense of incongruity felt at address between clubs having different numbers increases.

6. Features

According to the above-described embodiment, the following effects can be achieved.

Figure 8:
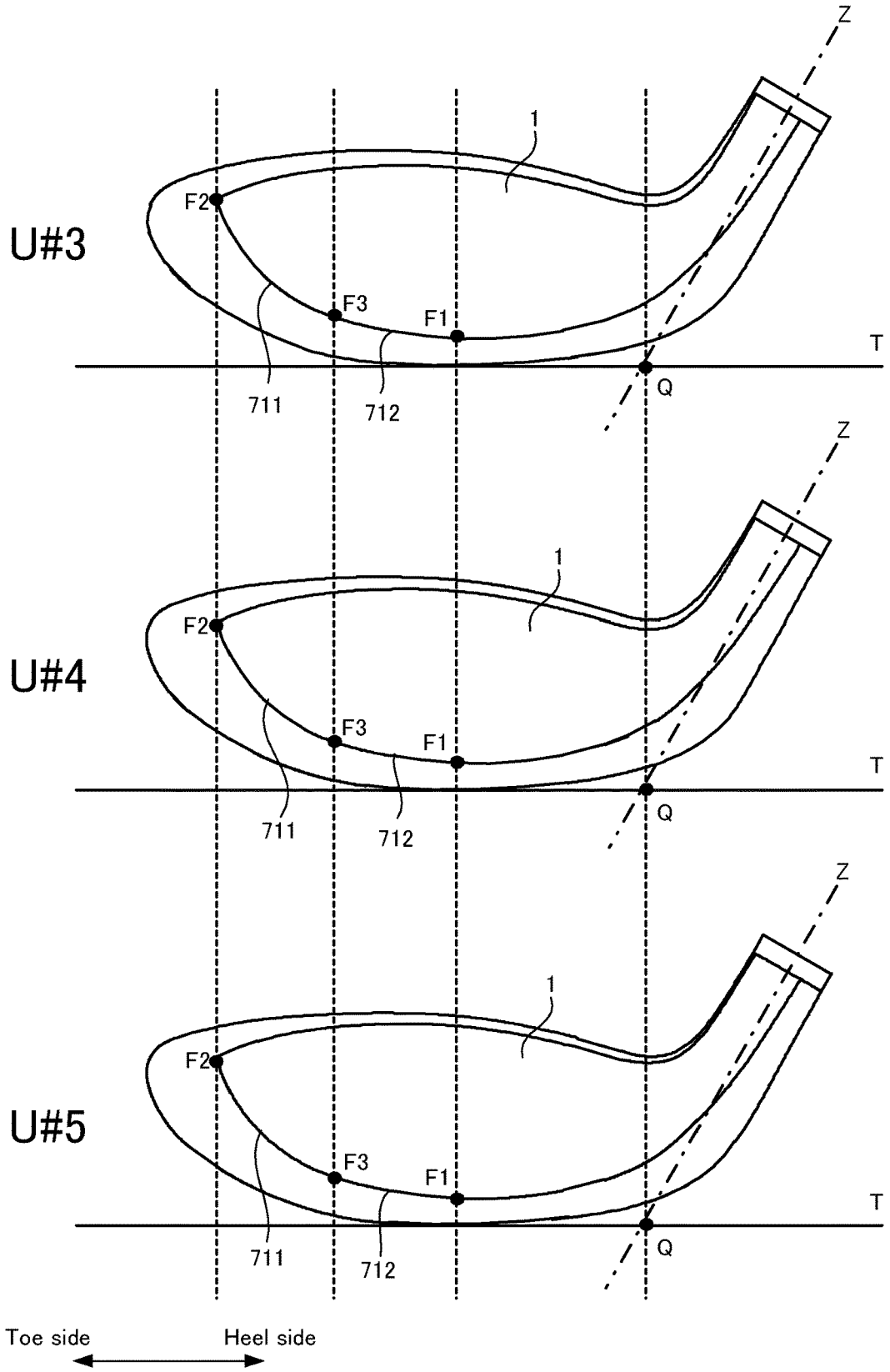
FIG. 8 is a front view of golf club heads having different loft angles that are included in a conventional golf club set.
Figure 9:
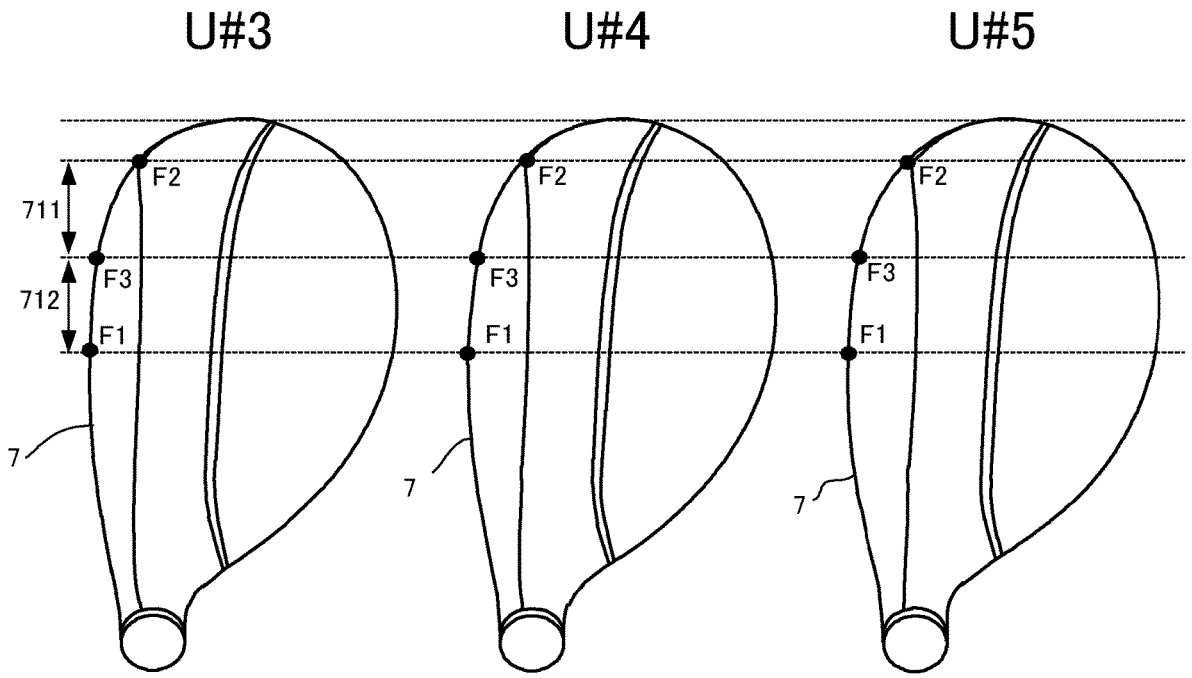
FIG. 9 is a plan view of FIG. 8.

(1) The golf clubs are configured so that clubs having higher loft angles have a smaller curvature radius of the first toe-side lower edge line 711. As such, the following effects can be achieved. First, as shown in FIG. 8, in the conventional golf club set, the lower edge lines 7 of the face parts 1 of the golf clubs have substantially the same shape even for the clubs having different numbers. As such, as shown in FIG. 9, when viewed from the golfer at address, golf clubs having higher loft angles have a first toe-side lower edge line 711 that look to be inclined further toward the back as the first toe-side lower edge line 711 progresses toward the toe. For this reason, the extent of curvature of the lower edge line 7 looks different for each club number, and therefore when the golfer changes the club, the golfer may feel a sense of incongruity at address, and thus have trouble addressing the ball. Also, if the first toe-side lower edge line 711 looks to be inclined toward the back, there is a risk that the golfer will find it difficult to align the head in the target direction at address. In particular, if the golfer is right-handed, the golfer may also feel that the ball will be hit rightward of the intended hitting direction.

Figure 10:
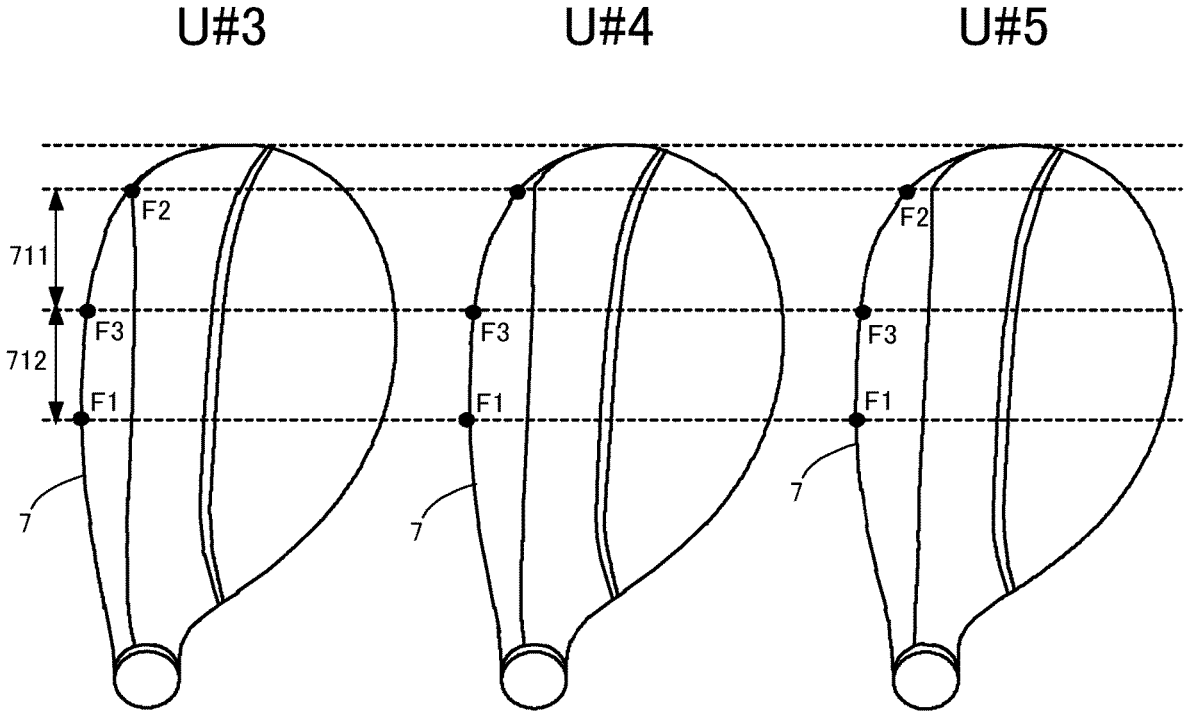
FIG. 10 is a plan view of golf club heads having different loft angles that are included in the golf club set according to the present invention.

In view of this, in the present embodiment, as described with reference to FIG. 6, the golf club heads (U #3, U #4, and U #5) are configured such that the clubs having higher loft angles have a smaller curvature radius of the first toe-side lower edge line 711 of the face part 1. Accordingly, as shown in FIG. 10, even if the loft angle becomes higher, the first toe-side lower edge line 711 looks to protrude further forward, and thus the difference in appearance of the first toe-side lower edge line 711 between clubs having different numbers can be reduced. As a result, the sense of incongruity felt at address between clubs having different numbers can be reduced, and addressing the ball after changing the club can be facilitated.

(2) Also, the golf club set according to the present embodiment is configured such that clubs having higher loft angles have a larger curvature radius of the second toe-side lower edge line 712, in addition to the configuration of the first toe-side lower edge line 711. Accordingly, even for the clubs having high loft angles, the second toe-side lower edge lines 712 look straighter than the conventional golf clubs. That is, the second toe-side lower edge lines 712 of all the golf club heads (U #3, U #4, and U #5) similarly look straight, and thus it is possible to reduce the sense of incongruity felt at address between clubs having different numbers. As a result, addressing the ball after changing the club can be facilitated.

Note that, in a case where the curvature radius of the second toe-side lower edge line 712 remains the same even for golf clubs having higher loft angles, when viewed from the golfer at address, the golf clubs having higher loft angles have a second toe-side lower edge line 712 that looks to be inclined further toward the back as the second toe-side lower edge line 712 progresses toward the toe. Also, the golfer may find it difficult to align the head in the target direction at address. In particular, if the golfer is right-handed, the golfer may also feel that the ball will be hit rightward of the intended hitting direction. In view of this, as described above, increasing the curvature radius of the second toe-side lower edge line 712 in golf club heads having higher loft angles makes it possible to reduce such a sense of incongruity felt at address.

(3) In the crown part 2, the protruding part 21 is formed to be higher than the base part 22 via the sloped surface 23, and thus the height of the face part 1 can be increased by the amount by which the protruding part 21 rises. This makes it possible to improve the rebound performance at the face part 1. Additionally, only the protruding part 21 is formed to be higher in the crown part 2, whereas the base part 22, which occupies most of the crown part 2, is formed in a position that is lower than the protruding part 21. This makes it possible to lower the center of gravity of the head.

7. Variations

An embodiment of the present invention has been described above. However, the present invention is not intended to be limited to the above-described embodiment. Many modifications can be made thereto without departing from the spirit of the present invention. The following variations can also be combined as appropriate. The following variations are possible, for example.

7.1

Although the above-described embodiment describes decreasing curvature radii of the first toe-side lower edge lines 711 and increasing the curvature radius of the second toe-side lower edge line 712 in clubs having higher loft angles, it is sufficient if at least the curvature radius of the first toe-side lower edge line 711 is decreased. That is, decreasing the curvature radius of the first toe-side lower edge line 711 in the golf clubs having higher loft angles can reduce the above-described discomfort felt in addressing. However, if the curvature radiuses of both the first toe-side lower edge line 711 and the second toe-side lower edge line 712 are adjusted as above, it is possible to reduce the sense of incongruity felt at address to a greater extent.

7.2

Figure 11:
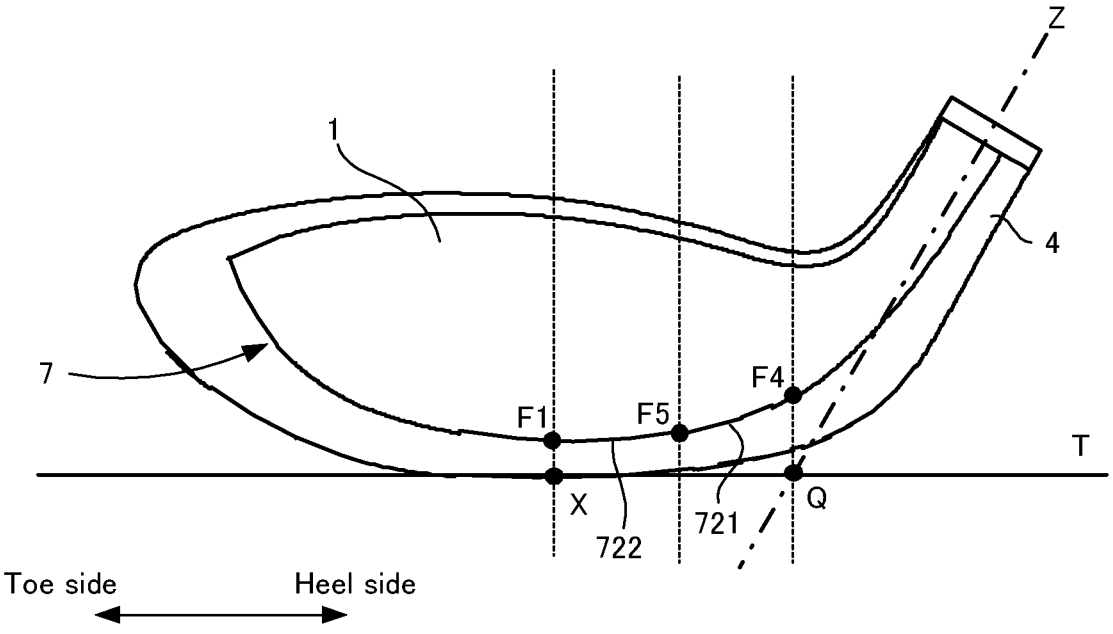
FIG. 11 is a front view of the golf club head illustrating the lower edge line of the face part.

Although the above-described embodiment describes the toe-side lower edge line in the lower edge line of the face part, the heel-side lower edge line can be set similarly. For example, as illustrated in FIG. 11, the intersection point of the lower edge line 7 and a plane that passes through the above-described point Q when the golf club head is in the reference state and is perpendicular to the toe-heel direction is denoted as F4. Also, the midpoint between F1 and F4 in the toe-heel direction is denoted as F5. The portion that extends between F5 and F4 of the lower edge line 7 is defined as a first heel-side lower edge line 721 and the portion that extends between F1 and F5 is defined as a second heel-side lower edge line 722.

When defined as above, the curvature radius of the first heel-side lower edge line 721 can be reduced in clubs having higher loft angles. In other words, when the curvature radii of the first heel-side lower edge lines 721 of U #3, U #4, and U #5 are denoted as C1, C2, and C3, respectively, the relationship C1>C2>C3 holds true. Accordingly, similarly to the first toe-side lower edge line 711, even for clubs having higher loft angles, the first heel-side lower edge line 721 looks to be protruding further forward, and thus it is possible to reduce the difference in shape of the first heel-side lower edge lines 721 in clubs having different numbers. As a result, the sense of incongruity felt at address between clubs having different numbers can be reduced, and addressing the ball after changing the club can be facilitated.

Note that, in a case where the curvature radius of the first heel-side lower edge line 721 remains the same even for golf clubs having higher loft angles, when viewed from the golfer at address, the golf clubs having higher loft angles have a first heel-side lower edge line 721 that looks to be inclined further toward the back as the first heel-side lower edge line 721 progresses toward the heel. For this reason, the golfer may find it difficult to align the head in the target direction at address. In particular, if the golfer is right-handed, the golfer may also feel that the ball will be hit leftward of the intended hitting direction. In view of this, as described above, decreasing the curvature radius of the first heel-side lower edge line 721 in golf clubs having higher loft angles makes it possible to reduce such a sense of incongruity felt at address.

On the other hand, the curvature radius of the second heel-side lower edge line 722 can be increased in clubs having higher loft angles. In other words, when the curvature radii of the second heel-side lower edge lines 722 of U #3, U #4, and U #5 are denoted as J1, J2, and J3, respectively, the relationship J1<J2<J3 holds true. Accordingly, the second heel-side lower edge lines 722 of all the golf club heads (U #3, U #4, and the U #5) similarly look straight, and thus it is possible to reduce the sense of incongruity felt at address between clubs having different numbers. As a result, addressing the ball after changing the club can be facilitated.

Note that, in a case where the curvature radius of the second heel-side lower edge line 722 remains the same even for golf clubs having higher loft angles, when viewed from the golfer at address, the golf clubs having higher loft angles have a second heel-side lower edge line 722 that looks to be inclined further to the back as the second heel-side lower edge line 722 progresses toward the heel. For this reason, the golfer may find it difficult to align the head in the target direction at address. In particular, if the golfer is right-handed, the golfer may also feel that the ball will be hit leftward of the intended hitting direction. In view of this, as described above, increasing the curvature radius of the second heel-side lower edge line 722 in golf clubs having higher loft angles makes it possible to reduce such a sense of incongruity felt at address.

Specifically, for example, the curvature radii can be set as follows, but the present invention is not intended to be limited thereto.

TABLE 2

| | Curvature radius of first heel-side lower edge line | Curvature radius of second heel-side lower edge line |
|---|---|---|
| U#3 | 65.4 mm | 86.3 mm |
| U#4 | 60.4 mm | 91.3 mm |
| U#5 | 57.4 mm | 94.3 mm |

Also, the curvature radius of the first heel-side lower edge line 721 is preferably 75 to 95 mm. The difference between the curvature radii of the first heel-side lower edge lines 721 of clubs having consecutive numbers (e.g., U #3 and U #4) is preferably 1 to 20 mm. According to the present embodiment, the sense of incongruity felt at address between clubs having different numbers can be reduced as described above, but the above range is specified because, especially if the difference between the curvature radii is too large, the sense of incongruity felt at address between clubs having different numbers will conversely increase.

On the other hand, the curvature radius of the second heel-side lower edge line 722 is preferably 70 to 100 mm. The difference between the curvature radii of the first heel-side lower edge lines 722 of clubs having consecutive numbers (e.g., U #3 and U #4) is preferably 1 to 20 mm. According to the present embodiment, the sense of incongruity felt at address between clubs having different numbers can be reduced as described above, but the above range is specified because, especially if the difference between the curvature radii is too large, the sense of incongruity felt at address between clubs having different numbers will conversely increase.

Note that, in the case of adjusting the curvature radii of the heel-side lower edge lines 721 and 722, it is sufficient if, out of the first heel-side lower edge line 721 and the second heel-side lower edge line 722, at least the curvature radius of the first heel-side lower edge line 721 is adjusted. Also, instead of adjusting the above-described first and second toe-side lower edge lines 711 and 712 as in the above-described embodiment, it is possible to adjust only the heel-side lower edge lines 721 and 722.

7.3

Although the above-described embodiment describes decreasing the curvature radius of the first toe-side lower edge line 711 in clubs having higher loft angles, this relationship does not necessarily have to hold true for all of the consecutive-numbered golf clubs in the golf club set. In other words, it is sufficient for the relationship to hold true for at least two clubs having a higher loft angle and a lower loft angle in the golf club set. Thus, for example, in the clubs from U #3 to U #6, when the curvature radii of the first toe-side lower edge lines 711 of the clubs U #3, U #4, U #5, and U #6 are denoted as M1, M2, M3, and M4, respectively, the relationships therebetween can be set to M1>M2=M3>M4, or to M1>M2>M3=M4. This also holds true for the second toe-side lower edge line 712, the first heel-side lower edge line 721, and the second heel-side lower edge line 722. Also, in any two golf clubs of the golf club set, the club having a lower loft angle corresponds to the first golf club of the present invention, and the club having a higher loft angle corresponds to the second golf club of the present invention.

7.4

When the above-described first toe-side lower edge line 711, the second toe-side lower edge line 712, the first heel-side lower edge line 721, and the second heel-side lower edge line 722 are formed by an arc having one curvature radius, it is possible to set the above-described relationship depending on the curvature radius. On the other hand, if the lower edge lines 711, 712, 721, and 722 are formed by combining arcs having different curvature radii, an arc that passes through both ends and the center (not the center in the toe-heel direction, but the center of the line segment) of each lower edge line is set, and the curvature radius of that arc can be used.

7.5

Although the head widths and the head thicknesses are uniform for all of the clubs in the above-described embodiment, the head widths and the head thicknesses do not necessarily have to be uniform, and can be set to be different.

7.6

Although the crown part 2 of the head according to the foregoing embodiment includes the protruding part 21, the shape of the protruding part 21 is not particularly limited. A crown part 2 without the protruding part 21 is also possible. The shape of the sole part 3 is also not particularly limited.

7.7

The "golf club set" according to the present invention refers to a golf club set including the same type of golf clubs, and a single golf club set includes only utility type golf clubs such as described above. However, in addition to utility type golf clubs, the golf club set according to the present invention can also be constituted by golf clubs having wood type heads such as fairway woods, and iron type heads, for example.

LIST OF REFERENCE NUMERALS

1 Face part
2 Crown part
3 Sole part
4 Hosel part
7 Lower edge line
711 First toe-side lower edge line
712 Second toe-side lower edge line
721 First heel-side lower edge line
722 Second heel-side lower edge line

What is claimed is:

1. A golf club set constituted by a plurality of golf clubs having different loft angles, wherein
each of the golf clubs includes a shaft and a golf club head,
each of the golf club heads includes:
a crown part;
a face part;
a sole part; and
a hosel part to which the shaft is attached,
in the face part, a lower edge line that is a boundary with the sole part curves so as to protrude downward,
when a first point, a second point, and a third point are defined on the lower edge line, the first point being a lowermost point when the golf club head is in a reference state, the second point being a toe-side end, and the third point being a midpoint between the first point and the second point in a toe-heel direction, the lower edge line includes a first toe-side lower edge line that extends from the second point to the third point, and a second toe-side lower edge line that extends from the first point to the third point, and
out of the plurality of golf clubs, at least a pair of a first golf club having a lower loft angle and a second golf club having a higher loft angle are configured such that a difference between a curvature radius of the first toe-side lower edge line of the first golf club and a curvature radius of the second toe-side lower edge line of the first golf club is smaller than a difference between a curvature radius of the first toe-side lower edge line of the second golf club and a curvature radius of the second toe-side lower edge line of the second golf club.

2. The golf club set according to claim 1, wherein
a difference between the curvature radius of the first toe-side lower edge line of the first golf club and the curvature radius of the first toe-side lower edge line of the second golf club is within 20 mm.

3. The golf club set according to claim 1, wherein
the plurality of golf clubs include a golf club in which the first toe-side lower edge line has a curvature radius of 20 to 40 mm.

4. The golf club set according to claim 1, wherein
the first golf club and the second golf club are configured such that the curvature radius of the second toe-side lower edge line of the second golf club is larger than the curvature radius of the second toe-side lower edge line of the first golf club.

5. The golf club set according to claim 4, wherein
a difference between the curvature radius of the second toe-side lower edge line of the first golf club and the curvature radius of the second toe-side lower edge line of the second golf club within 40 mm.

6. The golf club set according to claim 4, wherein
the plurality of golf clubs include a golf club in which the second toe-side lower edge line has a curvature radius of 60 to 120 mm.

7. The golf club set according to claim 1, wherein
a length of each of the golf club heads in the toe-heel direction is 60 to 120 mm.

8. The golf club set according to claim 1, wherein
the crown portion of the golf clubs includes:
a protruding part extending in a toe-heel direction along at least part of the face portion;
a base part arranged further on a back side than the protruding part; and
a step region extending in the toe-heel direction between a first region and a second region, and extending downward toward the second region from the first region side.

9. The golf club set according to claim 1, wherein
the golf clubs are hybrid type golf clubs.

10. The golf club set according to claim 1, wherein the curvature radius of the first toe-side lower edge line of the first club is greater than 30 mm and the curvature radius of the first toe-side lower edge line of the second club is less than 30 mm.

11. The golf club set according to claim 1, wherein the curvature radius of the first toe-side lower edge line of the first club is approximately 32 mm.

12. The golf club set according to claim 1, wherein a curvature radius of the second toe-side lower edge line of the first club is approximately 85 mm.

13. The golf club set according to claim 1, wherein the curvature radius of the first toe-side lower edge line of the second club is approximately 27 mm or approximately 24 mm.

14. The golf club set according to claim 1, wherein a curvature radius of the second toe-side lower edge line of the second club is approximately 90 mm or approximately 116 mm.

15. The golf club set according to claim 1, wherein the difference between the curvature radius of the first toe-side lower edge line and the curvature radius of the second toe-side lower edge line increases as the club number of the respective club increases for successive club numbers.

16. The golf club set according to claim 1, wherein the difference between the curvature radius of the first toe-side lower edge line and the curvature radius of the second toe-side lower edge line of the first club is approximately 53 mm.

17. The golf club set according to claim 1, wherein the difference between the curvature radius of the first toe-side lower edge line of the second golf club and the curvature radius of the second toe-side lower edge line of the second golf club is approximately 63 mm or approximately 91 mm.

* * * * *